United States Patent [19]

Quimby

[11] Patent Number: 5,019,863

[45] Date of Patent: May 28, 1991

[54] WEDGED-POLE HYBRID UNDULATOR

[75] Inventor: David C. Quimby, Bellevue, Wash.

[73] Assignee: Amoco Corporation, Chicago, Ill.

[21] Appl. No.: 102,879

[22] Filed: Sep. 30, 1987

[51] Int. Cl.[5] ..... H01F 7/00

[52] U.S. Cl. ..... 335/210; 335/306; 315/5.35

[58] Field of Search ..... 335/210, 211, 302, 303, 335/304, 306; 315/5.34, 5.35

[56] References Cited

U.S. PATENT DOCUMENTS

| | | | |
|---|---|---|---|
| 4,647,887 | 3/1987 | Leupold | 335/306 X |
| 4,654,618 | 3/1987 | Leupold | 335/306 X |
| 4,731,598 | 3/1988 | Clarke | 335/306 X |

OTHER PUBLICATIONS

Halbach, K., *Nuclear Instruments and Methods in Physics Research,* A250 (1986), pp. 115–119, "Some Concepts to Improve the Performance of DC Electromagnetic Wigglers" (North-Holland, Amsterdam).

Walker, R. P., *Nuclear Instruments and Methods in Physics Research,* A237 (1985), pp. 366–380, "Periodic Magnets for Free Electron Lasers" (North-Holland, Amsterdam).

*Primary Examiner*—George Harris

*Attorney, Agent, or Firm*—Seed and Berry

[57] ABSTRACT

A hybrid undulator made from axial arrays of rare-earth permanent magnets and highly permeable pole pieces. The pole pieces and magnets are wedge-shaped, with the same wedge angle, and fit together with the wedge angle of the magnets directed away from the axis and the wedge angle of the pole pieces directed toward the axis. The pole pieces can extend closer to the axis than the magnets. The wedged-pole undulator produces increased on-axis magnetic fields, and the wedge angle can be chosen to prevent magnetic field saturation inside the pole pieces.

18 Claims, 2 Drawing Sheets

FIG. 1A
PRIOR ART
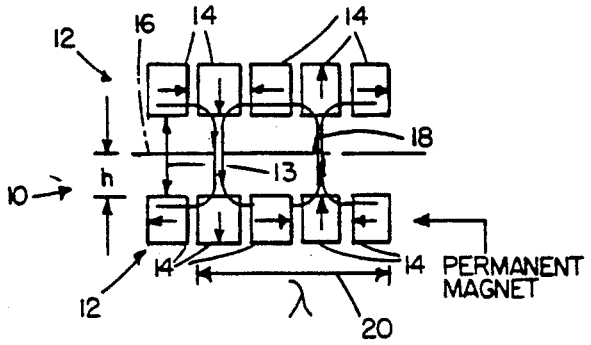
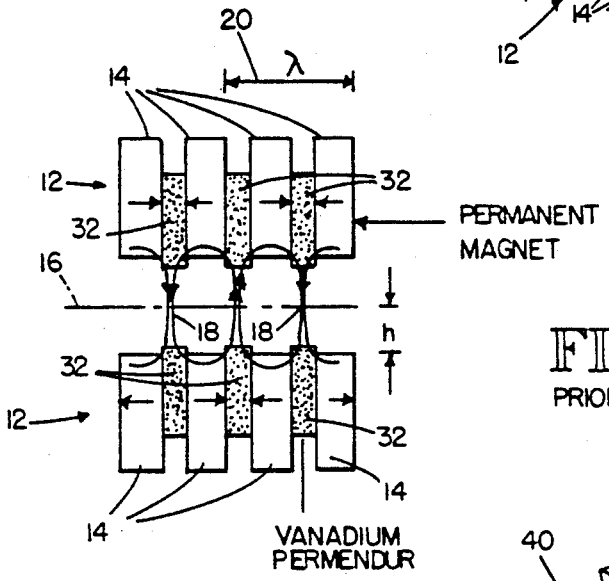
FIG. 1B
PRIOR ART
FIG. 2
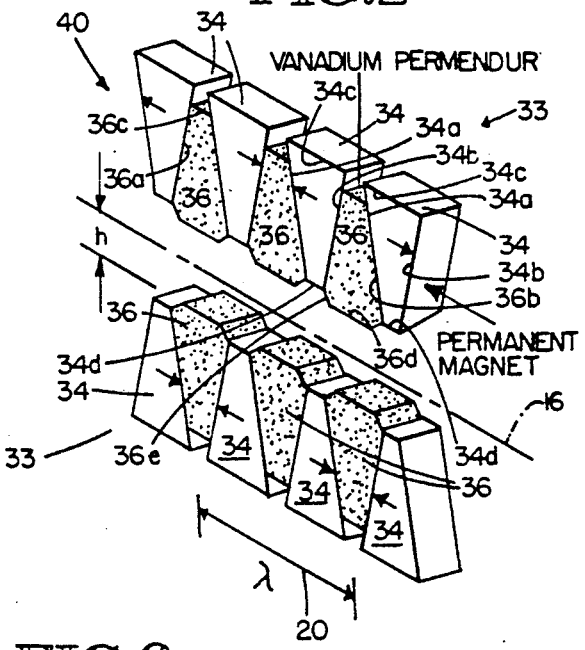
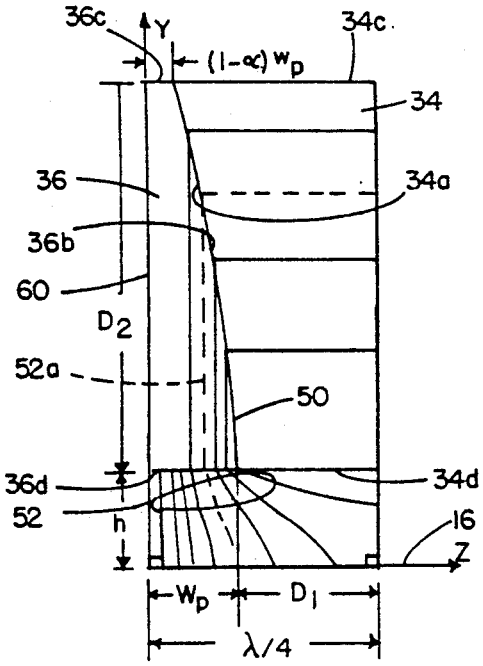
FIG. 6

FIG. 4
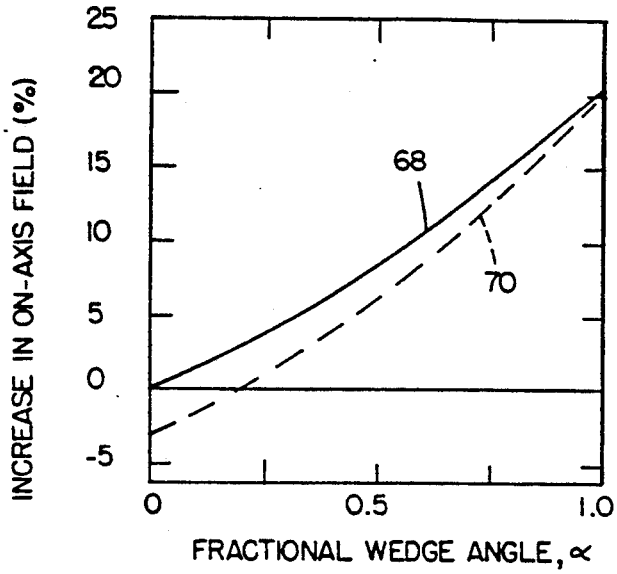
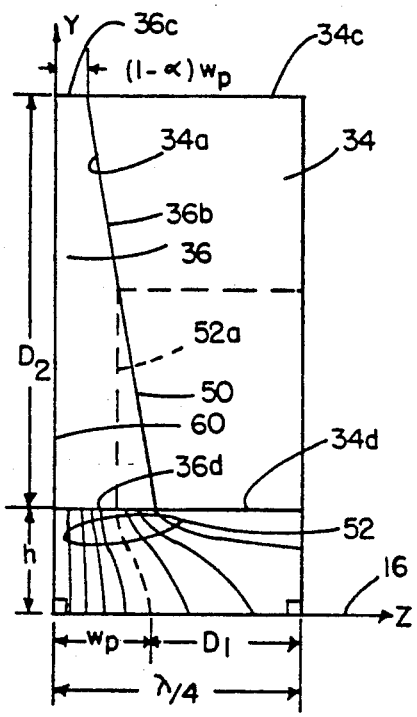
FIG. 3
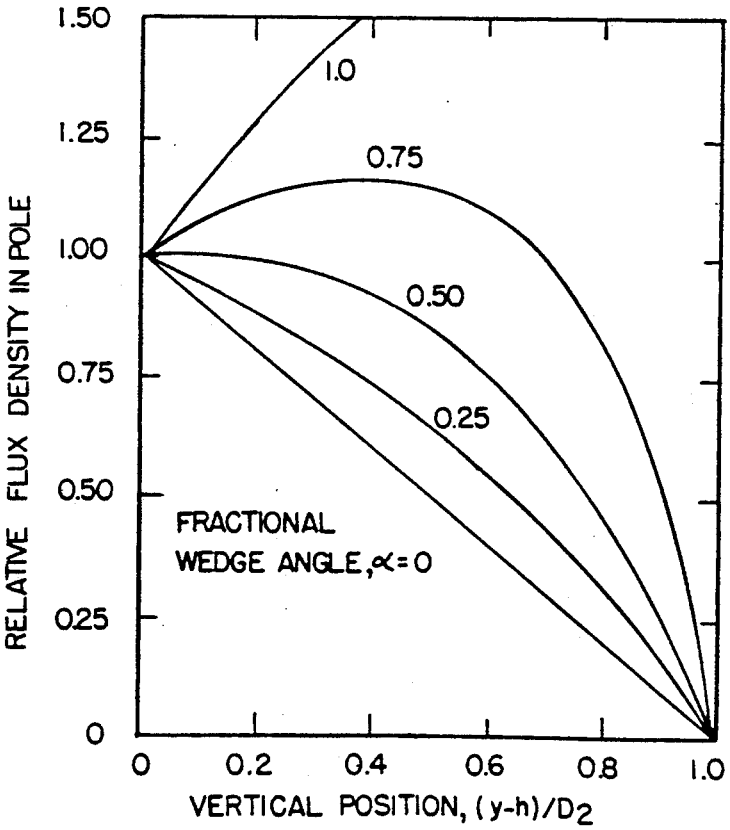
FIG. 5

WEDGED-POLE HYBRID UNDULATOR

TECHNICAL FIELD

This invention relates to an apparatus for producing a periodic magnetic field, and more particularly, to a permanent magnet hybrid undulator.

BACKGROUND ART

High-quality, high-strength periodic magnetic fields are required in free electron lasers and as insertion devices for synchrotron radiation generation. The devices that provide the desired magnetic fields are referred to as undulators (or wigglers). They have taken several forms in the past, but all forms are characterized by the period of the magnetic field along an axis and by the transverse size of the magnetic field.

Originally, undulators were implemented as linear arrays of electromagnets with spatially-alternating excitation to generate the desired magnetic fields. However, such implementations were bulky and difficult to maintain.

It has long been known that rare-earth permanent magnets (REPMs) are useful in forming the desired periodic magnetic fields. Two parallel linear arrays of separate magnetized permanent magnets arranged along an axis and separated by a gap can produce the desired periodic magnetic field when the fields of the magnets are arranged in the proper sequence. The distribution of the magnetic fields is determined by the strength and magnetic orientation of the REPMs in the arrays.

In a later development, reported in *Journal de Physique* (Paris), vol. 44, p. C1-211 (1983), K. Halbach proposed a REPM-steel hybrid undulator that produces higher magnetic field strengths and higher field quality than are possible with a pure-REPM undulator. The REPM-steel undulator uses steel pole pieces interposed between the permanent magnets to improve the magnetic field distribution along the axis. The relative permeability of these steel pole pieces is much greater than one. The presence of the highly permeable pole pieces in the hybrid undulator drastically reduces the sensitivity of the design to magnetic orientation errors of the individual permanent magnets. The hybrid undulator's field distribution is determined primarily by pole shape and position, rather than the material properties. Therefore, the REPM material that can be used by the hybrid design can be less expensive and less well characterized than the material used in the pure-REPM undulator. However, a larger volume of REPM material is generally required.

The pole pieces cause the magnet surfaces that face the gap to be driven at a higher magnetic force, thereby increasing the on-axis magnetic field strength. Unfortunately, this conventional hybrid undulator suffers from magnetic field saturation of the poles. This, in turn, affects the field uniformity within the gap. In addition, the periodic magnetic fields they produced had undesirable high order frequency components.

It is, therefore, desirable to have an REPM hybrid undulator that can produce higher on-axis magnetic field strength and greater field uniformity in the gap, while avoiding pole saturation.

DISCLOSURE OF THE INVENTION

It is an object of the present invention to provide an REPM hybrid undulator that can produce higher on-axis field strength and improved field uniformity.

It is another object of the present invention to provide an REPM hybrid undulator that avoids pole saturation by increasing the cross-sectional area of the pole tip without sacrificing magnet volume.

It is still another object of the present invention to provide an REPM undulator that has reduced harmonic content in its field distribution.

According to one aspect, the invention comprises two linear arrays spaced apart to define a gap therebetween. Each array extends substantially parallel to the axis and has alternating magnetized permanent magnets and pole pieces. Each magnet is substantially identical in shape and substantially symmetric with respect to a plane passing through the axis, and has first and second magnet sides converging toward each other in a direction toward the axis. The first and seccond magnet sides are oriented substantially symmetrically with respect to a plane that is perpendicular to the axis. Each magnet further has third and fourth magnet sides extending between the first and second magnet sides, the fourth magnet side being positioned toward the axis and the third magnet side being positioned spaced apart therefrom in a direction away from the axis. The third magnet side is of greater width than the fourth magnet side when measured between the first and second magnet sides. Each of the magnets has a retained magnetic field oriented substantially parallel to the axis and opposite in direction to the direction of the magnetic field of the next closest magnet in the array. Each array has the fourth magnet sides of each magnet in the array positioned a substantially uniform distance from the axis.

In addition, each pole piece is substantially identical in shape and substantially symmetric with respect to a plane passing through the axis, and has first and second pole piece sides converging toward each other in a direction away from the axis. The first and second pole piece sides are oriented substantially symmetrically with respect to a plane that is perpendicular to the axis. Each pole piece further has third and fourth pole piece sides extending between the first and second pole piece sides, the fourth pole piece side being positioned toward the axis and the third pole piece side being positioned spaced apart therefrom in a direction away from the axis. The fourth pole piece side is of greater width than the third pole piece side when measured between the first and second pole piece sides. At least a portion of the first magnet side of each magnet is adjacent and in juxtaposition with at least a portion of the second pole piece side of the next adjacent pole piece to one side in the array, and at least a portion of the second magnet side of each magnet is adjacent and in juxtaposition with at least a portion of the first pole piece side of the next adjacent pole piece to the other side in the array. Each array has the fourth pole piece sides of each pole piece in the array positioned a substantially uniform distance from the axis.

According to this first aspect of the invention, the magnets and pole pieces of each of the two linear arrays are positioned substantially symmetrically along the axis relative to the other array, with the magnets of the two linear arrays positioned opposite each other and the pole pieces of the two linear arrays positioned opposite each other, and with the magnetic fields of any two opposed magnets being oppositely directed with respect to the axis.

In a second aspect, the invention comprises two linear arrays spaced apart to define a gap therebetween. Each array extends substantially parallel to the axis and has alternating magnetized rare-earth permanent magnets and vanadium permendur pole pieces. Each magnet is substantially identical in shape and substantially symmetric with respect to a plane passing through the axis, and has first and second planar magnet sides converging toward each other in a direction toward the axis. The first and second planar magnet sides are oriented substantially symmetrically with respect to a plane that is perpendicular to the axis. Each magnet further has third and fourth planar magnet sides extending between the first and second planar magnet sides, the fourth planar magnet side being positioned toward the axis and the third planar magnet side being positioned spaced apart therefrom in a direction away from the axis. The third planar magnet side is of greater width than the fourth planar magnet side when measured between the first and second planar magnet sides. Each of the magnets has a retained magnetic field oriented substantially parallel to the axis and opposite in direction to the direction of the magnetic field of the next closest magnet in the array. Each array has the fourth planar magnet sides of each magnet in the array positioned a substantially uniform distance from the axis.

In addition, each pole piece is substantially identical in shape and substantially symmetric with respect to a plane passing through the axis, and has first and second planar pole piece sides converging toward each other in a direction away from the axis. The first and second planar pole piece sides are oriented substantially symmetrically with respect to a plane that is perpendicular to the axis. Each pole piece further has third and fourth planar pole piece sides extending between the first and second planar pole piece sides, the fourth planar pole piece side being positioned toward the axis and the third planar pole piece side being positioned spaced apart therefrom in a direction away from the axis. The fourth planar pole piece side is of greater width than the third planar pole piece side when measured between the first and second planar pole piece sides. At least a portion of the first planar magnet side of each magnet is adjacent and in juxtaposition with at least a portion of the second planar pole piece side of the next adjacent pole piece to one side in the array, and at least a portion of the second planar magnet side of each magnet being adjacent and in juxtaposition with at least a portion of the first planar pole piece side of the next adjacent pole piece to the other side in the array. Each array has the fourth planar pole piece sides of each pole piece in the array positioned a substantially uniform distance from the axis.

According to this second aspect of the invention, the magnets and pole pieces of each of the two linear arrays are positioned substantially symmetrically along the axis relative to the other array, with the magnets of the two linear arrays positioned opposite each other and the pole pieces of the two linear arrays positioned opposite each other, and with the magnetic fields of any two opposed magnets being oppositely directed with respect to the axis. In addition, the gap between opposed fourth planar pole piece sides is substantially smaller than an axial period of the hybrid magnetic field undulator.

BRIEF DESCRIPTION OF THE DRAWINGS

FIG. 1A is a schematic diagram of a portion of a pure-REPM undulator known in the prior art.

FIG. 1B is a schematic diagram of a portion of a conventional hybrid REPM undulator known in the prior art.

FIG. 2 is an isometric view of a portion of a wedged-pole undulator according to the present invention.

FIG. 3 is a schematic diagram of a quarter-period cell of a model of an undulator according to the present invention.

FIG. 4 is a graph of the increase in the on-axis field produced by an undulator made according to the present invention over the on-axis field of a comparable conventional hybrid REPM undulator, shown as a function of the fractional wedge angle of the pole.

FIG. 5 is a graph of flux density in the wedged pole of the present invention as a function of transverse position in the pole, with the fractional wedge angle used as a parameter.

FIG. 6 is schematic diagram of a quarter-period cell of an undulator according to an alternative embodiment of the present invention.

BEST MODES FOR CARRYING OUT THE INVENTION

Referring to FIG. 1A, a portion of a pure-REPM undulator 10 of a type known in the prior art can be seen to consist of two linear arrays 12 of permanent magnets 14. The magnets 14 can be made from any suitable rare-earth material. One common example of such a rare-earth material is $SmCo_5$. It is favored for its relatively high Curie temperature and radiation hardness. Another suitable rare-earth material, which has a higher remanent field strength than $SmCo_5$, is NdFe.

Each of the two linear arrays 12 is placed symmetrically along, and uniformly spaced from, an axis 16. A gap 13 between the two arrays 12, is two times the dimension h indicated in FIG. 1A, and is an important parameter in measuring undulator performance.

The magnets 14 in each of the arrays 12 are magnetized with magnetic fields that are either parallel to or perpendicular to the axis 16. The magnets 14 in each array are alternately oriented so that the direction of the magnetic fields alternate, as indicated by the bold arrows shown for each magnet in FIG. 1A. A magnet 14 whose magnetic field is perpendicular to the axis 16 is immediately adjacent a pair of magnets whose magnetic fields are parallel to the axis 16. Except for the magnet 14 on each of the extreme ends of the array 12, the fields of the two magnets that are immediately adjacent the magnet therebetween that has a magnetic field that is perpendicular to the axis 16 will both be directed either toward the middle magnet or away from the middle magnet 14. Similarly, a middle magnet 14 that has a magnetic field that is parallel to the axis 16 has positioned immediately adjacent thereto two magnets that have magnetic fields that are directed perpendicular to the axis 16 with oppositely directed magnetic fields.

The two arrays 12 are arranged so that each of the magnets 14 that has a magnetic field in one direction parallel to the axis 16 will be transversely opposite a correspondingly positioned magnet in the other array that has a magnetic field parallel thereto but in an opposite direction.

With this arrangement, the magnetic fields of the magnets 14 in the arrays 12 can be seen to generate closed flux lines 18 that define a spatial periodicity whose period, λ, is indicated by a double-headed arrow 20. The period of the undulator is a second important parameter of an undulator, the two parameters often being combined in the gap-to-period ratio, g/λ. The field distribution of the pure-REPM undulator is determined by the strength and magnetic orientation of the magnets 14.

The sensitivity of an undulator design is dramatically reduced by the presence of a permeable material. FIG. 1B is a schematic diagram of a portion of a conventional hybrid REPM undulator 30 known in the prior art. Each of the arrays 12 consists of alternating magnets 14 and pole pieces 32. The pole pieces 32 can be made from a highly permeable steel material such as vanadium permendur. The magnetic fields in the magnets 14 are parallel to the axis 16, and the directions of the magnetic fields in the magnet 14 alternate in both of the arrays 12. The arrays 12 are aligned so that magnet 14 in one array is transversely opposite a correspondingly positioned magnet in the other array and the opposing magnets have oppositely directed magnetic fields. Accordingly, then, the flux lines 18 of the hybrid REPM undulator of FIG. 1B can be placed closer than in the pure-REPM undulator 10 of FIG. 1A, for the same axial thickness of the magnets 14. The period λ of the hybrid REPM undulator 32, indicated by the double-headed arrow 20, can then be smaller than the period of the pure-REPM undulator 10.

The on-axis field strength of the conventional hybrid REPM undulator 30 is maximized when the pole pieces 32 are considerably narrower than the magnets 14. This not only leads to considerably higher-order harmonic content in the field distribution, but also means that the achievable field strength is limited by pole tip saturation. The pole tip saturation can be alleviated by making the pole pieces 32 wider (along the direction of the axis 16). To maintain the same while making the pole pieces 32 wider means that the magnets 14 must be made smaller. This loss of magnet volume results in a field decrease. In order to overcome the conflicting aims of increasing on-axis field strength while avoiding pole tip saturation, a wedged-pole design has been tried.

A portion of a wedged-pole undulator 40 of the present invention is shown in FIG. 2 and includes two arrays 33, each including alternating positioned permanent magnets 34 and the pole pieces 36. Each of the magnets 34 has first and second sides **34*a* and 34*b*, respectively, which converge toward each other in a direction toward the axis 16 to define a wedge shape. The magnet also has spaced-apart third and fourth sides 34*c* and 34*d*, respectively, extending between the first and second magnet sides 34*a* and 34*b***, with the third side being positioned away from the axis and the fourth side being positioned toward the axis and being of lesser width than the third side.

Each of the pole pieces 36 is of a generally similar wedge shape, although reversed in orientation relative to the axis 16, having first and second sides **36*a* and 36*b*, respectively, which converge toward each other in a direction away from the axis. The pole piece has spaced-apart third and fourth sides 36*c* and 36*d*, respectively, extending between the first and second pole piece sides 36*a* and 36*b***, with the fourth side being positioned toward the axis and the third side being positioned away from the axis and being of lesser width than the fourth side.

Except for the magnets 34 on each of the extreme ends of arrays 33, each magnet has its first magnet side **34*a* in close juxtaposition with the second pole piece side 36*b* of the adjacent pole piece 36 to one side thereof which has a matching shape, and each magnet has its second magnet side 34*b* in close juxtaposition with the first pole piece side 36*a* of the adjacent pole piece to the opposite side thereof which has a matching shape. The angular orientation of the first and second magnet sides 34*a* and 34*b* and the first and second pole piece sides 36*a* and 36*b* is selected such that the array 33 formed by the magnets and pole pieces is linear, with all magnets equally spaced from the axis and with all pole pieces equally spaced from the axis. Each of the two arrays 33 is substantially identical and arranged relative to the axis 16** so as to be symmetrical with the other array.

In the embodiment of FIG. 2, the pole pieces 36 project beyond the magnets 34 in the direction of the axis 16, such that the fourth pole piece side **36*d* is positioned closer to the axis than the fourth magnet side 34*d*. Each of the pole pieces 36 is provided with the fourth pole piece side 36*d* having a chamfered edge 36*e* to define a protruding chamfered tip. While the magnets 34 and the pole pieces 36 do not have to be wedge-shaped (as shown in FIG. 2), as long as they are tapered to provide an enlarged pole piece toward the axis and are symmetrical in a central plane which is perpendicular to the axis, it is particularly convenient to manufacture smoothly tapered, substantially wedge-shaped magnets and pole pieces. As in the hybrid REPM undulator 30 of FIG. 1B, the magnetic fields of adjacent magnets 34 in the same array 33 in FIG. 2 are parallel to the axis 16**, but oppositely directed.

Since the wedged-pole design has both larger pole tip cross-sectional area and larger magnet volume, somewhat higher flux can be driven through the pole piece 36 when saturation is the limiting factor. This higher flux capability can be used to produce higher fields along the axis 16, particularly in the fundamental component. Alternatively, the field uniformity can be improved by operating the poles farther from saturation without loss of field strength. These conclusions hold for both $SmCo_5$ and NdFe, but become increasingly more relevant as pole piece saturation becomes more important—that is, at higher remanent field strength and at smaller gap-to-period ratios. At larger gap-to-period ratios, the primary advantage of the wedged-pole configuration is production of higher on-axis field levels, since pole saturation is of less concern. These benefits are achieved at the expense of somewhat larger magnet volume requirements as well as the difficulty of precisely forming poles and magnets having a trapezoidal cross section.

FIG. 3 is a schematic diagram of a quarter-period cell of a model of an undulator according to the present invention shown viewed in cross section taken through the common plane and shown without the fourth pole piece side **36*d* extending beyond the fourth magnet side 34*d*. The illustrated half sections of the magnet 34 and the pole piece 36 are held closely together along corresponding second magnet side 34*a* and first pole piece side 36*b* to define an interface 50 therebetween. Magnetic field lines or flux paths 52 are shown extending from the axis 16 and passing through the fourth pole piece side 36*d*, and through the body of the pole piece to the interface 50. For clarity, only one of the field lines 52*a* (shown as a broken line) is shown in FIG. 3, extending fully between the axis 16 and the interface 50**.

At the interface 50, the field lines 52 substantially align with the magnetic field in the magnet 34.

While, as shown in FIG. 3, each of the magnets 34 and the pole pieces 36 can have the same length ($D_2$), as measured in a direction perpendicular to the axis 16, in general it is only necessary that their respective lengths, $2D_1$ and $2w_p$, as measured in a direction parallel to the axis, are held constant. It is noted that since only one-half of the magnet and pole piece is illustrated in this direction, their true widths are two times $D_1$ and $w_p$. As indicated in FIG. 3, the sum of these widths is one-quarter of the period of the undulator. The angle of the interface 50 of the wedge-shaped pole piece 36 is measured by the ratio of the difference between the widths of the fourth and third pole piece sides **36*d* and 36*c*, respectively, and the width of the fourth pole piece 36*d***. This parameter is referred to as the fractional wedge angle.

When the fractional wedge angle is zero, the interface 50 extends perpendicularly to the axis 16, so that the pole piece 36 and the magnet 34 both have rectangular cross sections when viewed in the common plane. When the fractional wedge angle is one, the interface 50 extends from the point where the fourth pole piece side **36*d* and fourth magnet side 34*d* meet to the point at which a center line 60 of the pole piece extending perpendicular to the axis 16 intersects the third pole piece side 36*c*. In this case, the cross section of the entire pole piece 36 is a symmetric triangle. The trapezoidal shape of the magnet 34 ranges from a rectangle when the fractional wedge angle is zero, to a shape with a maximum third magnet side 34*c*** when the fractional wedge angle is one.

FIG. 4 shows the percentage increase in the on-axis magnetic field for an undulator made according to the present invention over the on-axis magnetic field of a comparable conventional hybrid REPM undulator such as shown in FIG. 1B. The pole pieces 32 of the conventional hybrid REPM undulator have sides that are perpendicular to the axis 16.

For the data shown in the FIG. 4, the gap-to-period ratio is assumed to be 0.22. It is also assumed that the magnet and the pole pieces extend equally closely to the axis 16 and that the pole piece tips (i.e., the fourth pole piece side **36*d* in FIG. 3) have a constant flux density. The solid line curve 68 represents a comparison of performance of the two undulators when the magnetic flux density at the pole tips is the maximum possible for a conventional REPM undulator. The dashed line curve 70** represents the comparison of the two undulators when the magnetic flux density at the pole tips is ninety percent of the maximum possible. When the fractional wedge angle is zero, the wedge-pole undulator is identical to the conventional hybrid undulator. Therefore, the wedged-pole undulator should show no increase in on-axis field over the conventional hybrid undulator. However, when the pole tip flux density is reduced by ten percent (dashed line curve), the resulting on-axis field is reduced by approximately three percent. At the other extreme, when the fractional wedge angle approaches one, the increase in the on-axis field is approximately twenty percent.

The graph of FIG. 4 also shows that a wedged-pole undulator having a pole tip flux density that is ninety percent of the maximum possible with the conventional REPM undulator and a fractional wedge angle of approximately 0.2 produces an on-axis field equal to that produced by the conventional REPM undulator having the maximum possible pole tip flux density.

Although FIG. 4 shows results for fractional wedge angles up to one, the highest practical wedge angle is not this large. This is because saturation will occur internally to the pole piece 36 (rather than at the pole tip) for large wedge angles. Referring to FIG. 5, it is clear that the flux density within the pole piece 36 is extremely sensitive to fractional wedge angle. As indicated in FIG. 5, a fractional wedge angle of one clearly violates the assumption of unsaturated poles: the field level at the upper end of the pole exceeds the pole tip flux density by approximately a factor of two (not shown). In order to avoid saturation within the pole piece 36 (i.e., to prevent the internal flux density from exceeding one), the fractional wedge angle cannot be allowed to exceed 0.5. If it is desired to operate with a larger fractional wedge angle, the pole tip flux density must be reduced in order to prevent internal saturation. For example, if the pole tip flux density is reduced by seventeen percent, fractional wedge angles up to 0.75 could be used.

It should be noted that, as shown in the quarter-period cell of a second embodiment of the invention (in FIG. 6), a curved-shape pole piece having curved first and second pole piece sides **36*a* and 36*b* can be used, rather than a linear wedge, to eliminate saturation at large wedge angles. The curved-shape pole piece provides a greater width at points where the flux line density is expected to be greatest. The first and second magnet sides 34*a* and 34*b* are similarly curved to match the first and second pole piece sides 36*a* and 36*b***. However, this increased performance would require more complicated and expensive manufacturing.

One skilled in the art will readily appreciate that various modifications of the above-described embodiments may be made without departing from the spirit and the scope of the invention. Accordingly, the spirit and the scope of the present invention are to be limited only by the following claims.

I claim:

1. A hybrid magnetic field undulator disposed along an axis, comprising:

two linear arrays spaced apart to define a gap therebetween, each array extending substantially parallel to the axis and alternately having magnetized permanent magnets and pole pieces, each magnet being substantially identical in shape and substantially symmetric with respect to a plane passing through the axis, and having first and second magnet sides converging toward each other in a direction toward the axis, the first and second magnet sides being oriented substantially symmetrically with respect to a plane that is perpendicular to the axis, each magnet further having third and fourth magnet sides extending between the first and second magnet sides, the fourth magnet side being positioned toward the axis and the third magnet side being positioned spaced apart therefrom in a direction away from the axis, the third magnet side being of greater width than the fourth magnet side when measured between the first and second magnet sides, each of the magnets having a retained magnetic field oriented substantially parallel to the axis and opposite in direction to the direction of the magnetic field of the next closest magnet in the array, each array having the fourth magnet sides of each magnet in the array positioned a substantially uniform distance from the axis, and each pole piece being substantially identical in shape and symmetric with respect to a plane passing through the axis, and having first and second pole piece sides converging toward each other in a direction away from the axis, the first and second pole piece sides being oriented substantially symmetrically with respect to a plane that is perpendicular to the axis, each pole piece further having third and fourth pole piece sides extending between the first and second pole piece sides, the fourth pole piece side being positioned toward the axis and the third pole piece side being positioned spaced apart therefrom in a direction away from the axis, the fourth pole piece side being of greater width than the third pole piece side when measured between the first and second pole piece sides, at least a portion of the first magnet side of each magnet being adjacent and in juxtaposition with at least a portion of the second pole piece side of the next adjacent pole piece to one side in the array, and at least a portion of the second magnet side of each magnet being adjacent and in juxtaposition with at least a portion of the first pole piece side of the next adjacent pole piece to the other side in the array, each array having the fourth pole piece sides of each pole piece in the array positioned a substantially uniform distance from the axis, the magnets and pole pieces of each of the two linear arrays being positioned substantially symmetrically along the axis relative to the other array, with the magnets of the two linear arrays positioned opposite each other and the pole pieces of the two linear arrays positioned opposite each other, and with the magnetic fields of any two opposed magnets being oppositely directed with respect to the axis.

2. The hybrid magnetic field undulator of claim 1 wherein in each array the fourth pole piece sides are positioned closer to the axis than the fourth magnet sides.

3. The hybrid magnetic field undulator of claim 1 wherein the fourth pole piece sides are planar.

4. The hybrid magnetic field undulator of claim 1 wherein the gap between opposed fourth pole piece sides is substantially smaller than an axial period of the hybrid magnetic field undulator.

5. The hybrid magnetic field undulator of claim 1 wherein the pole pieces are made from vanadium permendur.

6. The hybrid magnetic field undulator of claim 1 wherein the permanent magnets are rare-earth permanent magnets.

7. The hybrid magnetic field undulator of claim 6 wherein the pole pieces are made from vandium permendur.

8. The hybrid magnetic field undulator of claim 1 wherein at least portions of the adjacent first magnet and second pole piece sides have matching surface contours, and at least portions of the adjacent second magnet and first pole piece sides have matching surface contours.

9. The hybrid magnetic field undulator of claim 8 wherein the matching surface contours are planar.

10. A hybrid magnetic field undulator disposed along an axis, comprising:

two linear arrays spaced apart to define a gap therebetween, each array extending substantially parallel to the axis and alternately having magnetized permanent magnets and pole pieces, each magnet being substantially identical in shape and substantially symmetric with respect to a plane passing through the axis, and having first and second planar magnet sides converging toward each other in a direction toward the axis, the first and second planar magnet sides being oriented substantially symmetrically with respect to a plane that is perpendicular to the axis, each magnet further having third and fourth magnet sides extending between the first and second planar magnet sides, the fourth magnet side being positioned toward the axis and the third magnet side being positioned spaced apart therefrom in a direction away from the axis, the third magnet side being of greater width than the fourth magnet side when measured between the first and second planar magnet sides, each of the magnets having a retained magnetic field oriented substantially parallel to the axis and opposite in direction to the direction of the magnetic field of the next closest magnet in the array, each array having the fourth magnet sides of each magnet in the array positioned a substantially uniform distance from the axis, and each pole piece being substantially identical in shape and symmetric with respect to a plane passing through the axis, and having first and second planar pole piece sides converging toward each other in a direction away from the axis, the first and second planar pole piece sides being oriented substantially symmetrically with respect to a plane that is perpendicular to the axis, each pole piece further having third and fourth pole piece sides extending between the first and second planar pole piece sides, the fourth pole piece side being positioned toward the axis and the third pole piece side being positioned spaced apart therefrom in a direction away from the axis, the fourth pole piece side being of greater width than the third pole piece side when measured between the first and second planar pole piece sides, at least a portion of the first planar magnet side of each magnet being adjacent and in juxtaposition with at least a portion of the second planar pole piece side of the next adjacent pole piece to one side in the array, and at least a portion of the second planar magnet side of each magnet being adjacent and in juxtaposition with at least a portion of the first planar pole piece side of the next adjacent pole piece to the other side in the array, each array having the fourth pole piece sides of each pole piece in the array positioned a substantially uniform distance from the axis, the magnets and pole pieces of each of the two linear arrays being positioned substantially symmetrically along the axis relative to the other array, with the magnets of the two linear arrays positioned opposite each other and the pole pieces of the two linear arrays positioned opposite each other, with the magnetic fields of any two opposed magnets being oppositely directed with respect to the axis, and with the gap between opposed fourth pole piece sides being substantially smaller than an axial period of the hybrid magnetic field undulator.

11. The hybrid magnetic field undulator of claim 10 wherein the pole pieces are made from vanadium permendur.

12. The hybrid magnetic field undulator of claim 10 wherein the permanent magnets are rare-earth permanent magnets.

13. The hybrid magnetic field undulator of claim 12 wherein the pole pieces are made from vanadium permendur.

14. The hybrid magnetic field undulator of claim 13 wherein in each array the fourth pole piece sides are chamfered adjacent the first and second pole piece sides.

15. The hybrid magnetic field undulator of claim 14 wherein the pole pieces are made from vanadium permendur.

16. The hybrid magnetic field undulator of claim 15 wherein the permanent magnets are rare-earth permanent magnets.

17. A hybrid magnetic field undulator disposed along an axis, comprising:

two linear arrays spaced apart to define a gap therebetween, each array extending substantially parallel to the axis and alternately having magnetized rare-earth permanent magnets and vanadium permendur pole pieces, each magnet being substantially identical in shape and substantially symmetric with respect to a plane passing through the axis, and having first and second planar magnet sides converging toward each other in a direction toward the axis, the first and second planar magnet sides being oriented substantially symmetrically with respect to a plane that is perpendicular to the axis, each magnet further having third and fourth planar magnet sides extending between the first and second planar magnet sides, the fourth planar magnet side being positioned toward the axis and the third planar magnet side being positioned spaced apart therefrom in a direction away from the axis, the third planar magnet side being of greater width than the fourth planar magnet side when measured between the first and second planar magnet sides, each of the magnets having a retained magnetic field oriented substantially parallel to the axis and opposite in direction to the direction of the magnetic field of the next closest magnet in the array, each array having the fourth planar magnet sides of each magnet in the array positioned a substantially uniform distance from the axis, and each pole piece being substantially identical in shape and symmetric with respect to a plane passing through the axis, and having first and second planar pole piece sides converging toward each other in a direction away from the axis, the first and second planar pole piece sides being oriented substantially symmetrically with respect to a plane that is perpendicular to the axis, each pole piece further having third and fourth planar pole piece sides extending between the first and second planar pole piece sides, the fourth planar pole piece side being positioned toward the axis and the third planar pole piece side being positioned spaced apart therefrom in a direction away from the axis, the fourth planar pole piece side being of greater width than the third planar pole piece side when measured between the first and second planar pole piece sides, at least a portion of the first planar magnet side of each magnet being adjacent and in juxtaposition with at least a portion of the second planar pole piece side of the next adjacent pole piece to one side in the array, and at least a portion of the second planar magnet side of each magnet being adjacent and in juxtaposition with at least a portion of the first planar pole piece side of the next adjacent pole piece to the other side in the array, each array having the fourth planar pole piece sides of each pole piece in the array positioned a substantially uniform distance from the axis, the magnets and pole pieces of each of the two linear arrays being positioned substantially symmetrically along the axis relative to the other array, with the magnets of the two linear arrays positioned opposite each other and the pole pieces of the two linear arrays positioned opposite each other, with the magnetic fields of any two opposed magnets being oppositely directed with respect to the axis, and with the gap between opposed fourth planar pole piece sides being substantially smaller than an axial period of the hybrid magnetic field undulator.

18. A device for manipulating a charged particle beam traveling along a beam path, said device comprising:

a pair of similar permanent magnets, one of said magnets having its magnetization aligned parallel to said beam path and in a direction opposite to the magnetization of the other said magnet;

an interstitial pole piece interposed between said magnets;

said magnets and interstitial pole piece aligned adjacent to and parallel to said beam path; and, one said interstitial pole piece cross section, in a plane which contains said beam path, being tapered away from said beam path.

* * * * *